US009055848B2

(12) United States Patent
Liu et al.

(10) Patent No.: US 9,055,848 B2
(45) Date of Patent: Jun. 16, 2015

(54) SUCTION CLEANER AND OPERATION METHOD THEREOF

(75) Inventors: Chun-Hsien Liu, Taipei (TW); Ya-Hui Tsai, Taoyuan County (TW); Chien-Feng Wu, Taichung (TW); Jia-Hsing Wu, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 919 days.

(21) Appl. No.: 13/195,038

(22) Filed: Aug. 1, 2011

(65) Prior Publication Data

US 2012/0111367 A1 May 10, 2012

Related U.S. Application Data

(60) Provisional application No. 61/411,932, filed on Nov. 10, 2010.

(30) Foreign Application Priority Data

Apr. 22, 2011 (TW) ..... 100114113 A

(51) Int. Cl.
*A47L 9/28* (2006.01)
*A47L 5/24* (2006.01)

(52) U.S. Cl.
CPC . *A47L 5/24* (2013.01); *A47L 9/281* (2013.01); *A47L 9/2842* (2013.01); *A47L 9/2857* (2013.01)

(58) Field of Classification Search
CPC ..... A47L 5/24; A47L 9/281; A47L 9/2857; A47L 9/2842
USPC ..... 15/319, 339
IPC ..... A47L 9/28
See application file for complete search history.

(56) References Cited

U.S. PATENT DOCUMENTS 4,377,639 A * 3/1983 Lee ..... 435/299.1
5,105,502 A * 4/1992 Takashima ..... 15/319
5,163,202 A 11/1992 Kawakami et al.

(Continued)

FOREIGN PATENT DOCUMENTS

CN 100438812 12/2008
DE 102007059930 2/2009

(Continued)

OTHER PUBLICATIONS

Svetlana Domnitcheva, "Smart Vacuum Cleaner-An Autonomous Location-Aware Cleaning Device", Institute for Pervasive Computing Swiss Federal Institute of Technology (ETH) Zurich, Switzerland, issued on 2004, p. 1-p. 2.

(Continued)

*Primary Examiner* — David Redding
(74) *Attorney, Agent, or Firm* — Jianq Chyun IP Office

(57) ABSTRACT

A suction cleaner and an operation method thereof are provided. The suction cleaner includes a housing, a holding part, an impeller module, at least one sensing device, and a controller. An end of the housing has a dust-suction opening. The impeller module is located inside the housing, and a channel is located between the impeller module and the dust-suction opening. The controller is electrically connected to the sensing device to drive and adjust the rotation rate and the suction force of the impeller module, and thus the power consumption of the suction cleaner can be reduced.

20 Claims, 9 Drawing Sheets

(56) References Cited

U.S. PATENT DOCUMENTS

| | | | | | |
|---|---|---|---|---|---|
| 5,233,682 | A | * | 8/1993 | Abe et al. | 706/52 |
| 5,301,385 | A | * | 4/1994 | Abe et al. | 15/319 |
| 5,507,067 | A | | 4/1996 | Hoekstra et al. | |
| 5,539,953 | A | * | 7/1996 | Kurz | 15/367 |
| 5,542,146 | A | * | 8/1996 | Hoekstra et al. | 15/319 |
| 5,613,269 | A | * | 3/1997 | Miwa | 15/319 |
| 5,819,367 | A | | 10/1998 | Imamura | |
| 5,881,430 | A | * | 3/1999 | Driessen et al. | 15/319 |
| 6,055,702 | A | * | 5/2000 | Imamura et al. | 15/339 |
| 7,805,803 | B2 | * | 10/2010 | Andrup et al. | 15/339 |
| 8,223,029 | B2 | * | 7/2012 | Chung et al. | 340/635 |
| 2005/0166354 | A1 | | 8/2005 | Uehigashi | |
| 2009/0119867 | A1 | * | 5/2009 | Senoo et al. | 15/319 |
| 2010/0318232 | A1 | * | 12/2010 | Tiekoetter et al. | 700/282 |

FOREIGN PATENT DOCUMENTS

| | | |
|---|---|---|
| JP | 02-144032 | 6/1990 |
| JP | 03-237949 | 10/1991 |
| JP | 04-056452 | 5/1992 |
| JP | 2005-058746 | 3/2005 |
| JP | 2005211365 | 8/2005 |
| JP | 2007143818 | 6/2007 |
| TW | 352921 | 2/1999 |
| TW | D123864 | 7/2008 |
| TW | D132819 | 1/2010 |
| TW | M387645 | 9/2010 |
| WO | 2010016210 | 2/2010 |

OTHER PUBLICATIONS

Roger D. Lewis et al., "A Comparison of the Sampling Characteristics of Two Vacuum Surface Samplers for the Collection of Dust Mite Allergen", Appl. Occup. Environ. Hyg 13(7), Jul. 1998, p. 536-p. 541.

Park et al., "Flow-induced noise in a suction nozzle with a centrifugal fan of a vacuum cleaner and its reduction", Applied Acoustics 71 (2010), p. 460-p. 469.

Cudina et al., "Noise generation by vacuum cleaner suction units Part II. Effect of vaned diffuser on noise characteristics" Applied Acoustics 68 (2007), p. 503-520.

"Office Action of Japan Counterpart Application", issued on Feb. 5, 2013, p. 1-p. 3.

"Office Action of China Counterpart Application", issued on Dec. 19, 2013, p. 1-p. 9.

"Office Action of China Counterpart Application", issued on Jul. 3, 2014, p. 1-p. 10.

"Office Action of China Counterpart Application", issued on Oct. 17, 2014, p. 1-p.5.

* cited by examiner

SUCTION CLEANER AND OPERATION METHOD THEREOF

CROSS-REFERENCE TO RELATED APPLICATION

This application claims the priority benefits of U.S. provisional application Ser. No. 61/411,932, filed on Nov. 10, 2010 and Taiwan application serial no. 100114113, filed on Apr. 22, 2011. The entirety of each of the above-mentioned patent applications is hereby incorporated by reference herein and made a part of this specification.

TECHNICAL FIELD

The disclosure relates to a suction cleaner and an operation method thereof. More particularly, the disclosure relates to a handheld suction cleaner and an operation method thereof.

BACKGROUND

A handheld suction cleaner is compact, cordless, and thus applicable to vehicles or in other places where no power jack is configured. However, the handheld suction cleaner is powered by a rechargeable battery, and the running time of the charged handheld suction cleaner soon begins to decline. In most cases, a conventional handheld suction cleaner can merely work for approximately ten minutes or more. Thereafter, the handheld suction cleaner is less capable of collecting dust due to insufficient power supply. Besides, the conventional handheld suction cleaner does not have intelligent functions. In other words, after the conventional handheld suction cleaner is turned on, it rotates at a single rotation rate, and the suction force and the rotation rate of the conventional handheld suction cleaner cannot be spontaneously adjusted based on the operating condition of the suction cleaner or the amount of dust collected by the suction cleaner.

Generally, after the handheld suction cleaner is turned on, the handheld suction cleaner collects dust at a constantly high rotation speed, and the limited running time of the charged handheld suction cleaner results from the significant power consumption of the suction cleaner operating at the high rotation speed. Even though the user has not yet started the dust-suction process, or the suction cleaner is not in contact with dust particles or debris, the suction cleaner in operation constantly generates a strong suction airflow, and thus the power stored in the rechargeable battery continues to be consumed. This reduces the running time of the charged suction cleaner.

SUMMARY OF THE INVENTION

In an exemplary embodiment of the disclosure, a suction cleaner that includes a housing, a holding part, an impeller module, a first sensing device, a second sensing device, a third sensing device, and a controller is provided. An end of the housing has a dust-suction opening. The holding part is connected to the housing. The impeller module is located inside the housing, and a channel is configured between the dust-suction opening and the impeller module. The first sensing device is configured on the holding part. The second sensing device is configured around the dust-suction opening. The third sensing device is configured in the channel. The controller is electrically connected to the first, second, and third sensing devices. Besides, the controller drives the impeller module to rotate at a rotation rate based on a sensing condition of the first, second, and third sensing devices.

An operation method of the suction cleaner is described below. After the suction cleaner is turned on, the controller stays in a powered-on state, such that the suction cleaner is in a standby state. When the holding part of the suction cleaner is being contacted, the controller drives the impeller module to rotate at a first rotation rate, such that the suction cleaner is in a ready-to-work state. When the suction cleaner comes close to or in contact with a surface of an object, the controller drives the impeller module to rotate at a second rotation rate, such that the suction cleaner is in a normal dust-suction state. When the suction cleaner collects a relatively small quantity of dust particles or debris, the controller drives the impeller module to continuously rotate at the second rotation rate. When the suction cleaner collects a relatively large quantity of dust particles or debris, the controller drives the impeller module to rotate at a third rotation rate, such that the suction cleaner is in a maximum dust-suction state.

Other features and advantages of the disclosure will be further understood from the further technological features disclosed by the exemplary embodiments of the disclosure wherein there are shown and described exemplary embodiments of this disclosure, simply by way of illustration of modes best suited to carry out the disclosure.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EXEMPLARY EMBODIMENTS

Figure 1:
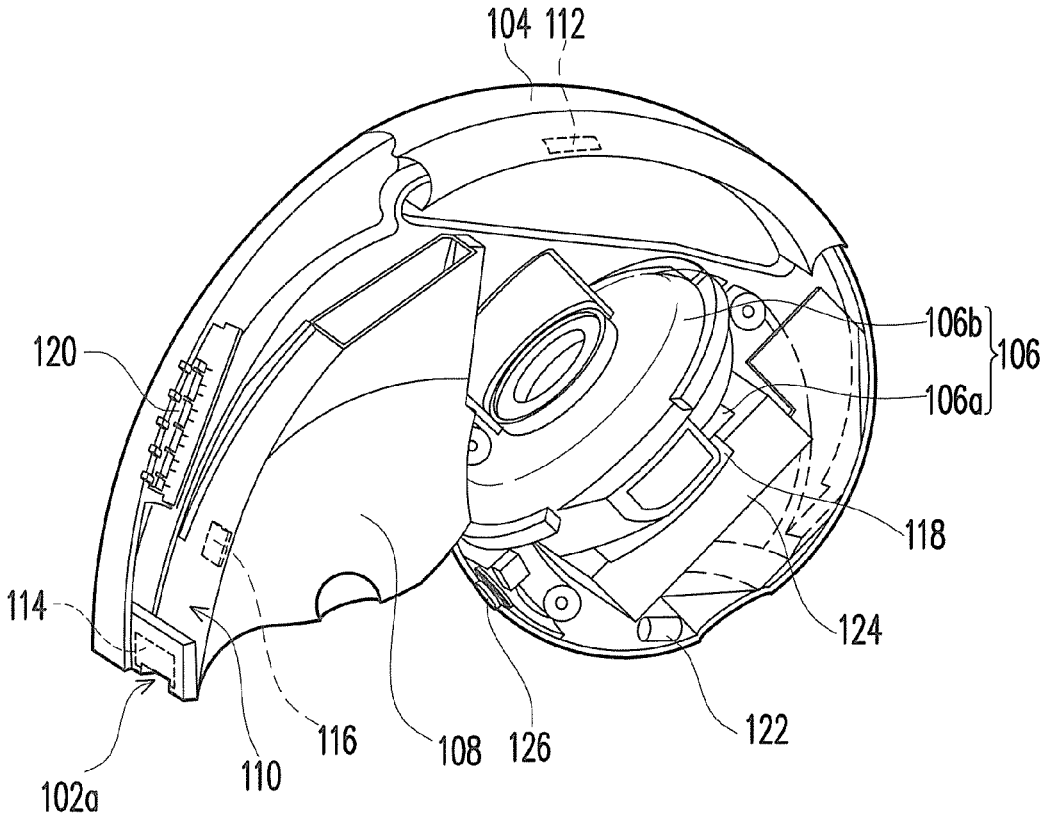
FIG. 1 is a schematic perspective view illustrating a suction cleaner according to an exemplary embodiment of the disclosure.
Figure 2:
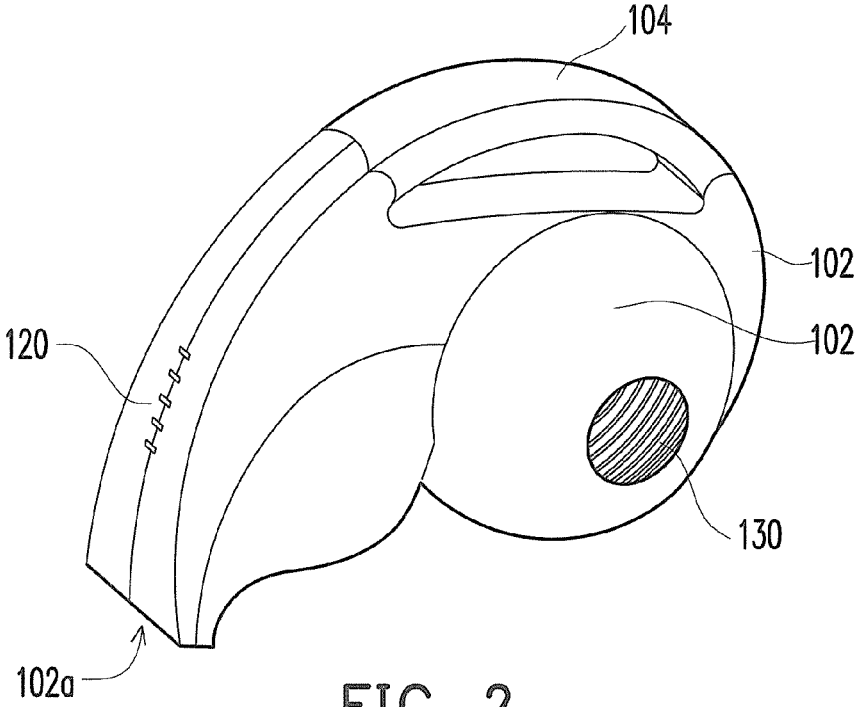
FIG. 2 is a schematic view illustrating the exterior design of the suction cleaner depicted in FIG. 1.

FIG. 1 is a schematic perspective view illustrating a suction cleaner according to this exemplary embodiment of the disclosure. FIG. 2 is a schematic view illustrating the exterior design of the suction cleaner according to this exemplary embodiment of the disclosure. With reference to FIG. 1 and FIG. 2, the suction cleaner of this exemplary embodiment includes a housing 102, a holding part 104, an impeller module 106, a dust-collecting container 108, a first sensing device 112, a second sensing device 114, a third sensing device 116, and a controller 118.

An end of the housing 102 has a dust-suction opening 102*a* through which dust particles or debris can be sucked into the suction cleaner. In this exemplary embodiment, the housing 102 can further includes an air outlet 130 for dissipating heat and circulating air within the suction cleaner.

The holding part 104 is connected to the housing 102. The embellished exterior of the suction cleaner is constituted by the housing 102 and the holding part 104. The holding part 104 of this exemplary embodiment is a handle, for instance, and the housing 102 and the holding part 104 together constitute the nautilus-like exterior of the suction cleaner. However, the disclosure is not limited thereto. In other exemplary embodiments of the disclosure, the housing 102 and the holding part 104 can be shaped in a different fashion.

The impeller module 106 is located inside the housing 102. Specifically, a channel 110 is configured between the dust-suction opening 102*a* and the impeller module 106. The impeller module 106 includes a motor 106*a* and an impeller structure 106*b* that is electrically connected to the motor 106*a*, such that the powered-on suction cleaner can generate a suction force. Certainly, the impeller module 106 can further include an impeller protection housing, a vent, and so on. Here, the impeller module 106 can be any type of impeller module employed in the conventional suction cleaner.

The dust-collecting container 108 is located inside the housing 102 and between the channel 110 and the impeller module 106. That is to say, the dust-collecting container 108 communicates with the channel 110 and the impeller module 106. Hence, when the impeller module 106 is actuated, the suction force generated by the impeller module 106 can arrive at the dust-suction opening 102*a* through the dust-collecting container 108 and the channel 110. Thereby, the dust particles or debris at the dust-suction opening 102*a* can be sucked into the dust-collecting container 108. The dust-collecting container 108 is applied for collecting the dust particles or debris.

Figure 3A:
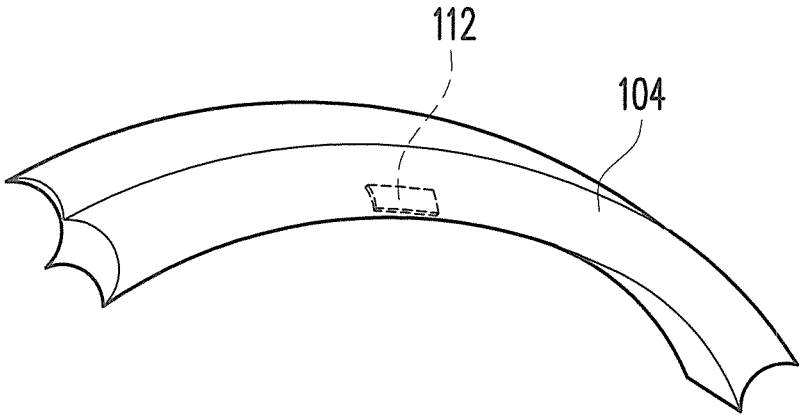
FIG. 3A and FIG. 3B are schematic views illustrating a first sensing device that is configured inside or outside a holding part according to several exemplary embodiments of the disclosure.
Figure 3B:
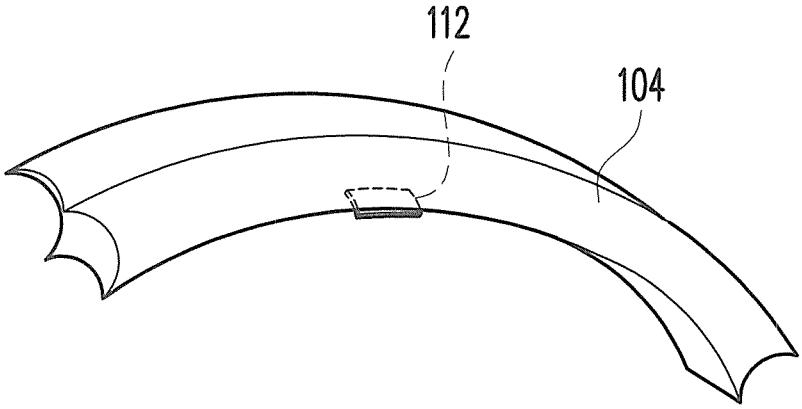

The first sensing device 112 is configured on the holding part 104. Here, the first sensing device 112 configured on the holding part 104 serves to sense and detect whether the user is in contact with the holding part 104. The first sensing device 112 can be configured inside the holding part 104, as indicated in FIG. 3A. Certainly, the first sensing device 112 can be configured outside the holding part 104, as indicated in FIG. 3B. Besides, the first sensing device 112 can be a contact sensing device or a non-contact sensing device. The contact sensing device is a button or a pressure sensor, for instance. The non-contact sensing device is an infrared sensor, a light blocking sensor, or a photo sensor, for instance.

For instance, if the first sensing device 112 is configured inside the holding part 104, as indicated in FIG. 3A, and the first sensing device 112 is a non-contact sensing device (e.g., the infrared sensor, the light blocking sensor, or the photo sensor), the holding part 104 can have a light transmittance zone corresponding to where the first sensing device 112 is located, so as to expose the first sensing device 112. When the user intends to use the suction cleaner and thus holds the holding part 104 and lifts the suction cleaner, a sensing light beam of the first sensing device 112 inside the holding part 104 is blocked by the hand of the user, such that the first sensing device 112 is driven to generate a sensing signal.

By contrast, if the first sensing device 112 is configured outside the holding part 104, as indicated in FIG. 3B, and the first sensing device 112 is a contact sensing device (e.g., the button or the pressure sensor), the first sensing device 112 on the holding part 104 is pressed when the user intends to use the suction cleaner, holds the holding part 104, and lifts the suction cleaner. Thereby, the first sensing device 112 is driven to generate a sensing signal.

Figure 4A:
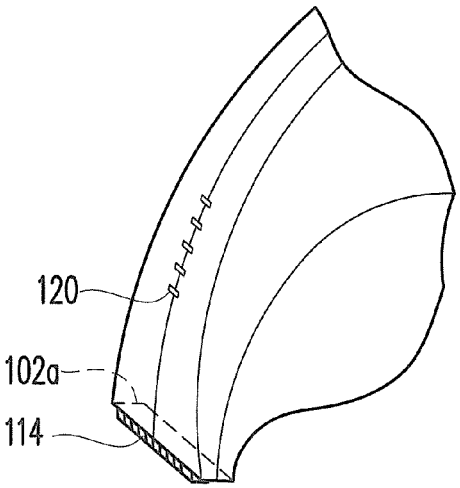
FIG. 4A to FIG. 4C are schematic views illustrating a second sensing device configured around a dust-suction opening according to several exemplary embodiments of the disclosure.
Figure 4B:
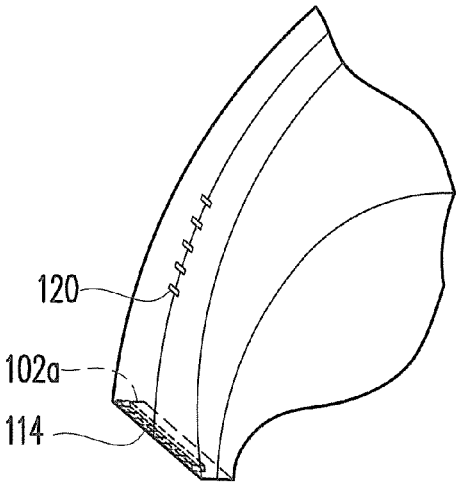
Figure 4C:
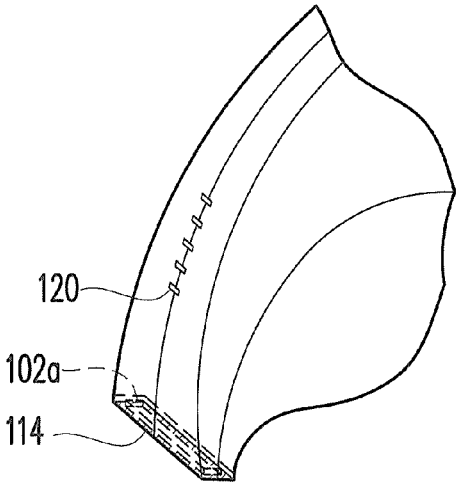

With reference to FIG. 1, the second sensing device 114 is configured around the dust-suction opening 102*a*. The second sensing device 114 around the dust-suction opening 102*a* serves to sense whether the dust-suction opening 102*a* is close to or in contact with a surface of an object (e.g., the floor, the tabletop, or any other surface of a certain object) where the dust or debris is to be collected. The second sensing device 114 can be configured outside the dust-suction opening 102*a* (as indicated in FIG. 4A), inside the dust-suction opening 102*a* (as indicated in FIG. 4B), or on an edge of the dust-suction opening 102*a* (as indicated in FIG. 4C). Besides, the second sensing device 114 can be a contact sensing device or a non-contact sensing device. The contact sensing device is a pressure sensor, for instance. The non-contact sensing device is an infrared sensor, a light blocking sensor, or a photo sensor, for instance.

For instance, it is assumed that the second sensing device 114 is configured outside the dust-suction opening 102*a* (as shown in FIG. 4A), and that the second sensing device 114 is the non-contact sensing device (e.g., the infrared sensor or the photo sensor). In this case, when the dust-suction opening 102*a* of the suction cleaner comes close to the surface of the object (e.g., the floor, the tabletop, or any other surface of a certain object) where the dust or debris is to be collected, a sensing light beam of the second sensing device 114 around the dust-suction opening 102*a* detects the surface of the object (e.g., the floor, the tabletop, or any other surface of a certain object) where the dust or debris is to be collected, and thereby the second sensing device 114 is driven to generate a sensing signal. In another exemplary embodiment, if the second sensing device 114 is a contact sensing device (e.g., the elastic sensor or the pressure sensor), the second sensing device 114 is driven to generate a sensing signal when the dust-suction opening 102*a* of the suction cleaner is in contact with the surface of the object (e.g., the floor, the tabletop, or any other surface of a certain object) where the dust or debris is to be collected.

Alternatively, it is assumed that the second sensing device 114 is configured inside the dust-suction opening 102*a* (as shown in FIG. 4B), and that the second sensing device 114 is the non-contact sensing device (e.g., the infrared sensor or the photo sensor). In this case, when the dust-suction opening 102*a* of the suction cleaner comes close to the surface of the object (e.g., the floor, the tabletop, or any other surface of a certain object) where the dust or debris is to be collected, a sensing light beam of the second sensing device 114 inside the dust-suction opening 102*a* detects the surface of the object (e.g., the floor, the tabletop, or any other surface of a certain object) where the dust or debris is to be collected, and thereby the second sensing device 114 is driven to generate a sensing signal.

If the second sensing device 114 is configured on the edge of the dust-suction opening 102*a*, as shown in FIG. 4C, the type of the sensor is determined based on whether the dust-suction opening 102*a* exposes the second sensing device 114. Namely, if the second sensing device 114 is configured on the edge of the dust-suction opening 102*a*, and the dust-suction opening 102*a* exposes the second sensing device 114, the second sensing device 114 can be the contact sensing device (e.g., the elastic sensor or the pressure sensor). If the second sensing device 114 is configured on the edge of the dust-suction opening 102*a*, and the dust-suction opening 102*a* does not expose the second sensing device 114, the second sensing device 114 can be the non-contact sensing device (e.g., the infrared sensor, the light blocking sensor, or the photo sensor) or the contact sensing device (e.g., the pressure sensor).

Figure 5A:
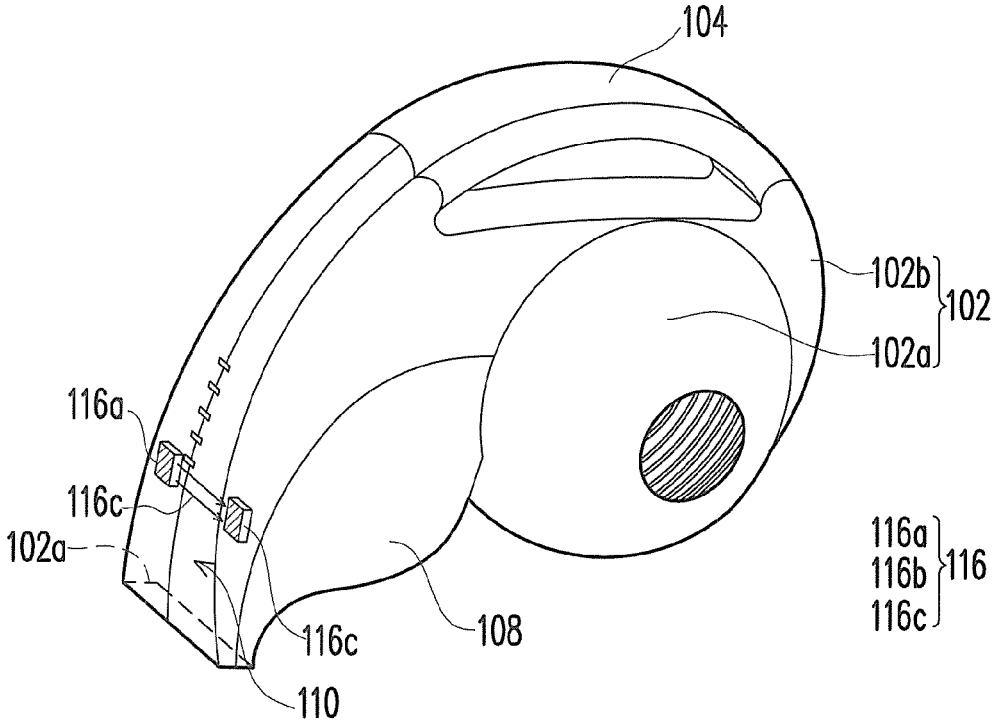
FIG. 5A and FIG. 5B are schematic views illustrating a third sensing device that is configured in a channel according to several exemplary embodiments of the disclosure.
Figure 5B:
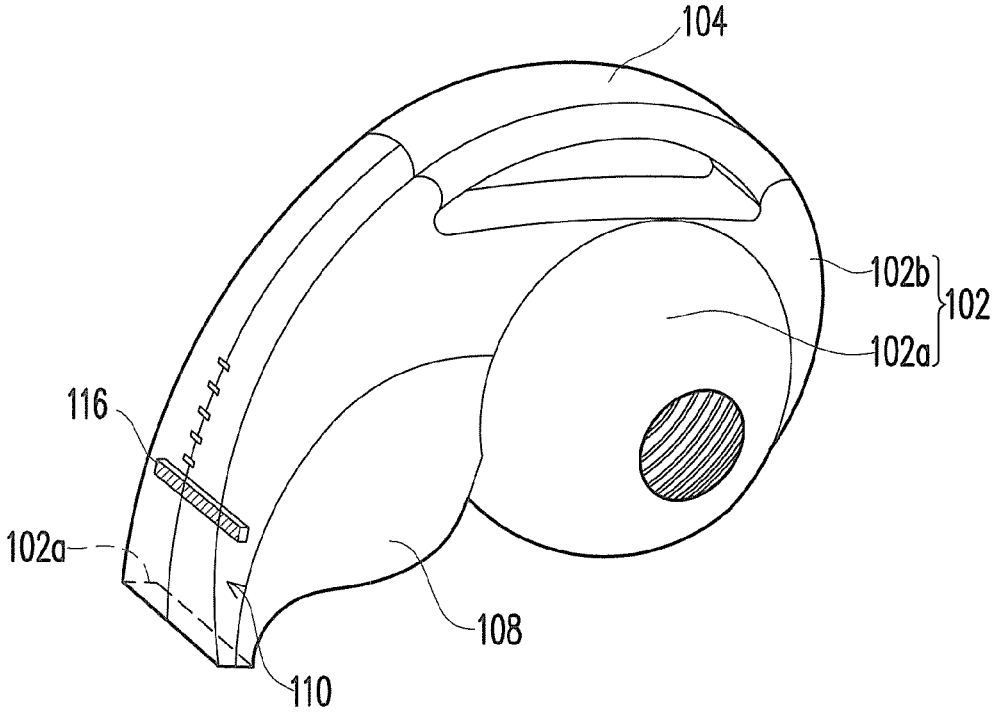

With reference to FIG. 1, the third sensing device 116 is configured in the channel 110 which is located between the dust-collecting container 108 and the dust-suction opening 102*a*. In other words, the third sensing device 116 is configured at a region where the sucked dust particles or debris pass before arriving at the dust-collecting container 108. The third sensing device 116 can sense the amount of the sucked dust particles or debris. Here, the third sensing device 116 can be a non-contact sensing device (as shown in FIG. 5A) or a contact sensing device (as shown in FIG. 5B). The contact sensing device can be a pressure sensor or a piezoelectric sensor. The non-contact sensing device can be an infrared sensor, a light blocking sensor, or a photo sensor.

For instance, it is assumed that the third sensing device 116 is the non-contact sensing device (e.g., the infrared sensor, the light blocking sensor, or the photo sensor), as indicated in FIG. 5A, and the third sensing device 116 includes a transmitter 116*a* and a receiver 116*b*. The transmitter 116*a* generates a light beam 116*c* and transmits the light beam 116*c* to the receiver 116*b*. When the suction cleaner collects dust particles or debris, the dust particles or debris blocks the light beam 116*c* before passing through the third sensing device 116, such that the light beam 116*c* is prevented from moving to the receiver 116*b*. Specifically, within a certain time frame, the more the amount of the sucked dust particles or debris, the more the amount of the dust particles or debris passing through the third sensing device 116. At this time, the light beam 116*c* of the third sensing device 116 is blocked by the sucked dust particles or debris to a greater extent. Accordingly, the area of the blocked light beam (i.e., the coverage of the blocked light beam) can be measured to determine the amount of the sucked dust particles or debris.

Alternatively, it is assumed that the third sensing device 116 is the contact sensing device (e.g., the pressure sensor or any other contact sensing device), as indicated in FIG. 5B. When the suction cleaner collects debris or dust particles, the debris or the dust particles hit the third sensing device 116 while passing through the third sensing device 116, and the third sensing device 116 is then driven to generate a sensing signal. Specifically, within a certain time frame, the more the amount of the sucked dust particles or debris, the more the amount of the dust particles or debris hitting the third sensing device 116. Accordingly, the extent to which the third sensing device 116 is hit can be evaluated to determine the amount of the sucked dust particles or debris.

With reference to FIG. 1, the controller 118 is configured inside the housing 102 and electrically connected to the first sensing device 112, the second sensing device 114, and the third sensing device 116, such that the sensing signals of the first, second, and third sensing devices 112, 114, and 116 can be transmitted to the controller 118. Based on the sensing signals transmitted from the first, second, and third sensing devices 112, 114, and 116, the controller 118 drives the impeller module 106 to rotate.

According to this exemplary embodiment, the suction cleaner further includes a power switch 126 that can be configured at any place on the housing 120, so as to allow the user to turn on or turn off the suction cleaner. In other exemplary embodiments of the disclosure, the power switch 126 of the suction cleaner can be configured on the holding part 104. The position of the power switch 126 is basically determined based on user's preference, the exterior design of the suction cleaner, and so forth. The power switch 126 is electrically connected to the controller 118. When the controller 118 receives an on signal or an off signal of the power switch 126, the controller 118 drives the impeller module 106 to be turned on or turned off based on the on signal or the off signal.

The suction cleaner further includes a display device 120 configured on the housing 102. The display device 120 can include a light emitting diode (LED) display device, an organic light emitting display (OLED) panel, a liquid crystal display (LCD) panel, or a liquid crystal display module (LCM). The display device 120 is electrically connected to the controller 118 as well. When the controller 118 receives the sensing signals of the sensing devices 112, 114, and 116, the controller 118 drives the impeller module 106 to operate based on the sensing signals and controls the display device 120 to display certain display signals.

Given the suction cleaner is a handheld suction cleaner or a cordless suction cleaner, the suction cleaner further includes a rechargeable battery 124 and a charge jack 122 that are configured inside the housing 120 and located at a side of the impeller module 106. The rechargeable battery 124 and the charge jack 122 serve to supply power required by the impeller module 106, the controller 118, the sensing devices 112, 114, and 116, the display device 120, and all the other components in the suction cleaner. The rechargeable battery 124 is electrically connected to the controller 118 as well. The controller 118 can receive the power storage capacity signal from the rechargeable battery 124, so as to control the display device 120 to show the power storage capacity. Further, the user can be reminded of recharging the battery if necessary.

Figure 6:
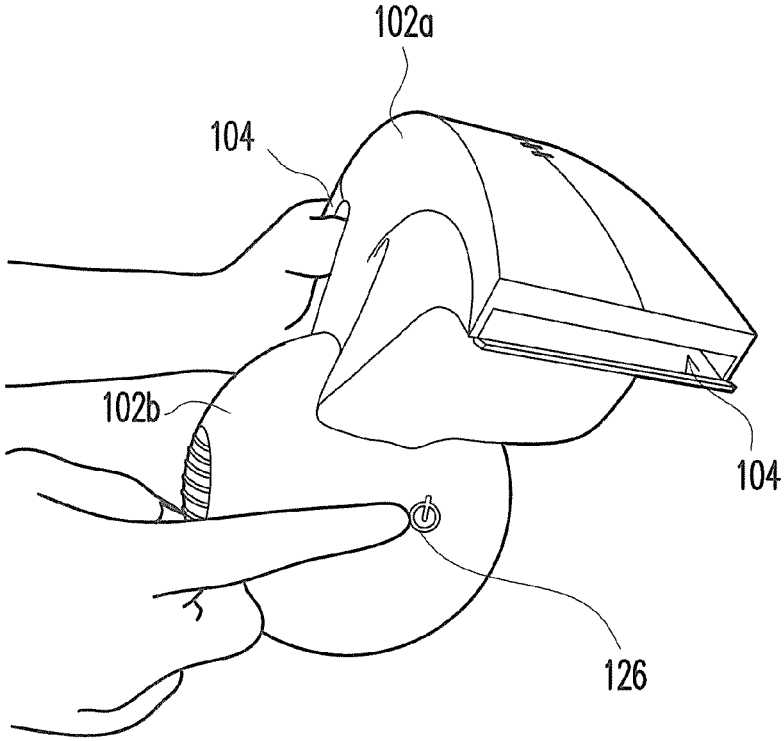
FIG. 6 to FIG. 12 are schematic views illustrating an operation method of the suction cleaner depicted in FIG. 1.

FIG. 6 to FIG. 12 are schematic views illustrating an operation method of the suction cleaner depicted in FIG. 1. With reference to FIG. 6, when the user intends to use the suction cleaner described in this exemplary embodiment, the user can turn on the suction cleaner by switching on the power switch 126 that is located on the housing 102.

Figure 7:
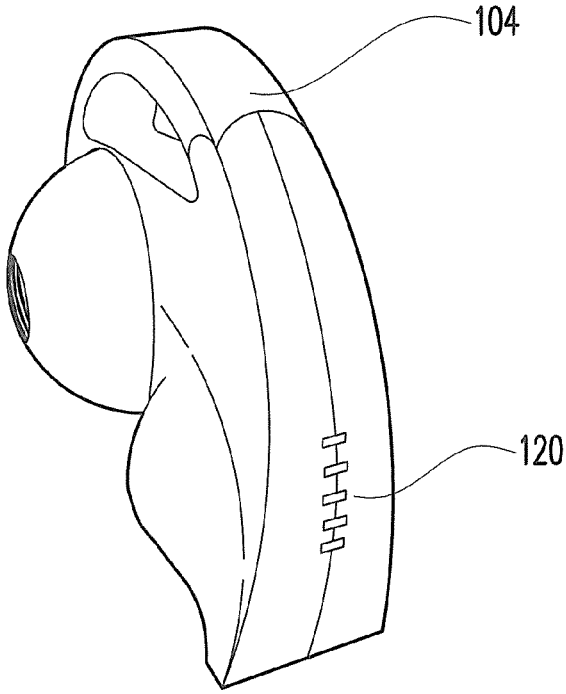

As shown in FIG. 7, after the suction cleaner is turned on, the components in the suction cleaner stay in a powered-on state. When the controller 118 receives the on signal from the power switch 126, the controller 118 controls the impeller module 106 to stay in a non-operating state. Hence, the suction cleaner is in a standby state at this time. In this exemplary embodiment, the controller 118 can drive the display device 120 to display the first signal corresponding to certain number of light (e.g., 0 or 1). Alternatively, the controller 118 can drive the LCM or LCD panel to display other display signals in form of letters, patterns, or color. Thereby, it is shown that the suction cleaner is in the standby state.

Figure 8:
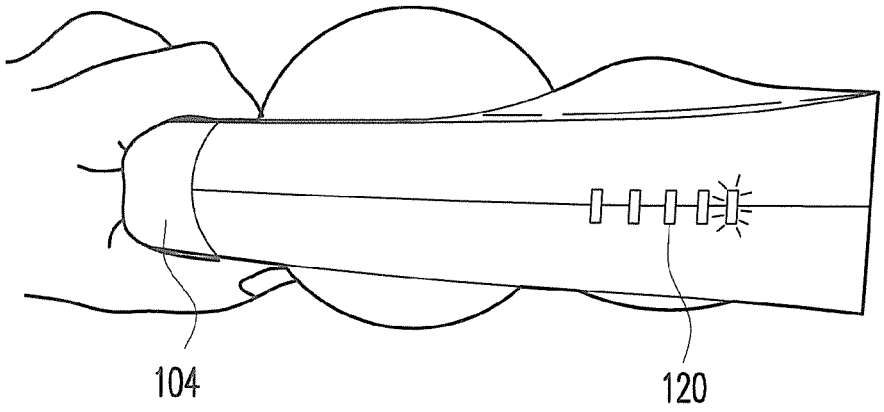

As indicated in FIG. 8, when the user picks up the suction cleaner, i.e., when the user is in contact with the holding part 104 of the suction cleaner, the first sensing device 112 configured on the holding part 104 generates the sensing signal. After the sensing signal is transmitted to the controller 118, the controller drives the impeller module 106 to rotate at a first rotation rate (i.e., a low rotation rate), and the suction cleaner here is in a ready-to-work state. At this time, the controller 118 further drives the display device 120 to display the second signal corresponding to certain number of light, for example, 1 or 2 (one more light than the number of light corresponding to the first signal). Alternatively, the controller 118 can drive the LCM or LCD panel to display other display signals in form of letters, patterns, or color. Thereby, it is shown that the suction cleaner is being held.

Figure 9:
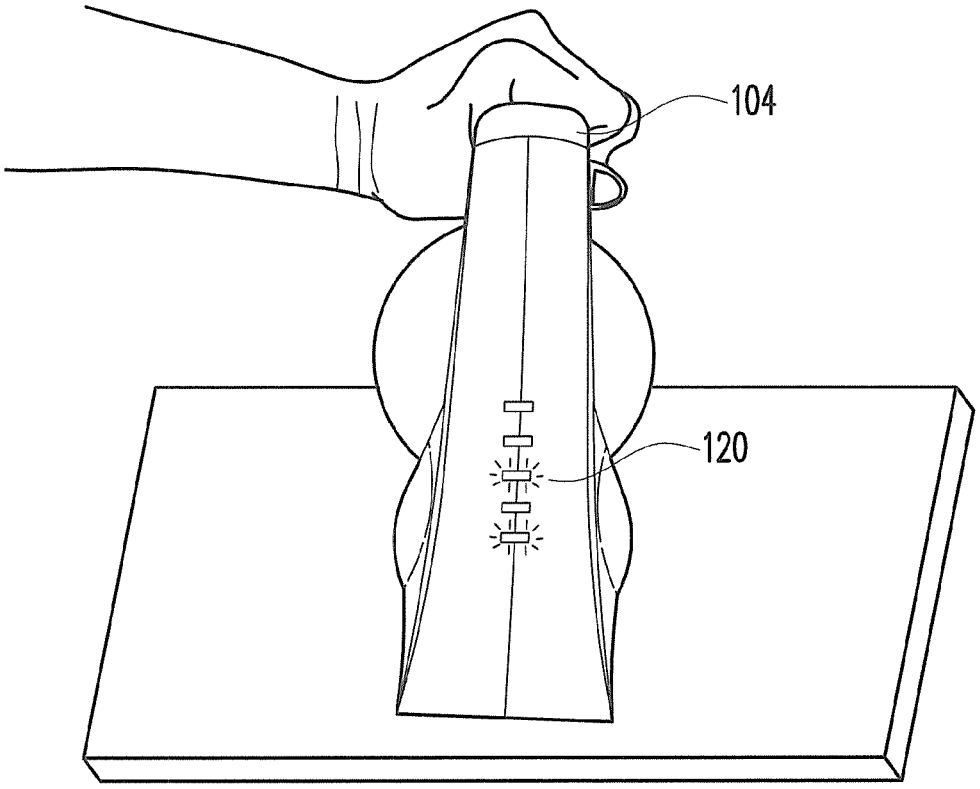

With reference to FIG. 9, when the suction cleaner comes close to or in contact with a surface of an object (e.g., the floor, the tabletop, or any other surface of a certain object) where the dust or debris is to be collected, the second sensing device 114 configured around the dust-suction opening 102*a* generates a sensing signal. After the sensing signal is transmitted to the controller 118, the controller 118 drives the impeller module 106 to rotate at a second rotation rate (i.e., a medium rotation rate). The suction cleaner here is in a normal dust-suction state. The controller 118 further drives the display device 120 to display the third signal corresponding to certain number of light, for example, 2 or 3 (one more light than the number of light corresponding to the second signal). Alternatively, the controller 118 can drive the LCM or LCD panel to display other display signals in form of letters, patterns, or color. Thereby, it is shown that the suction cleaner is close to or in contact with the surface of the object where the dust or debris is to be collected.

Figure 10:
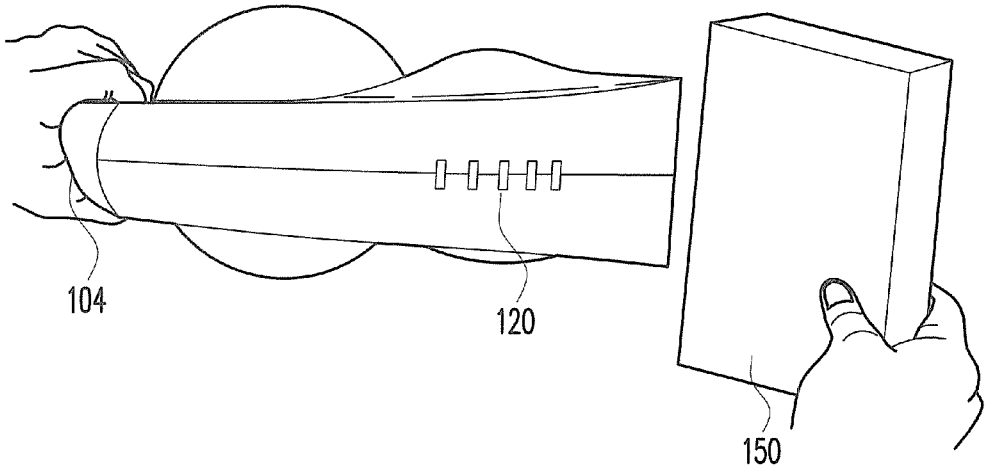

With reference to FIG. 10, even though the suction cleaner approaches a non-planar surface of an object, the second sensing device 114 configured around the dust-suction opening 102*a* can sense the object and thereby generate a sensing signal. Similarly, after the sensing signal is transmitted to the controller 118, the controller 118 drives the impeller module 106 to rotate at the second rotation rate, and the suction cleaner is in the normal dust-suction state. The controller 118 further drives the display device 120 to display the third signal corresponding to certain number of light, for example, 2 or 3 (one more light than the number of light corresponding to the second signal). Alternatively, the controller 118 can drive the display device 120 to display other display signals in form of letters, patterns, or color. Thereby, it is shown that the suction cleaner is close to or in contact with the surface of the object where the dust or debris is to be collected.

Figure 11:
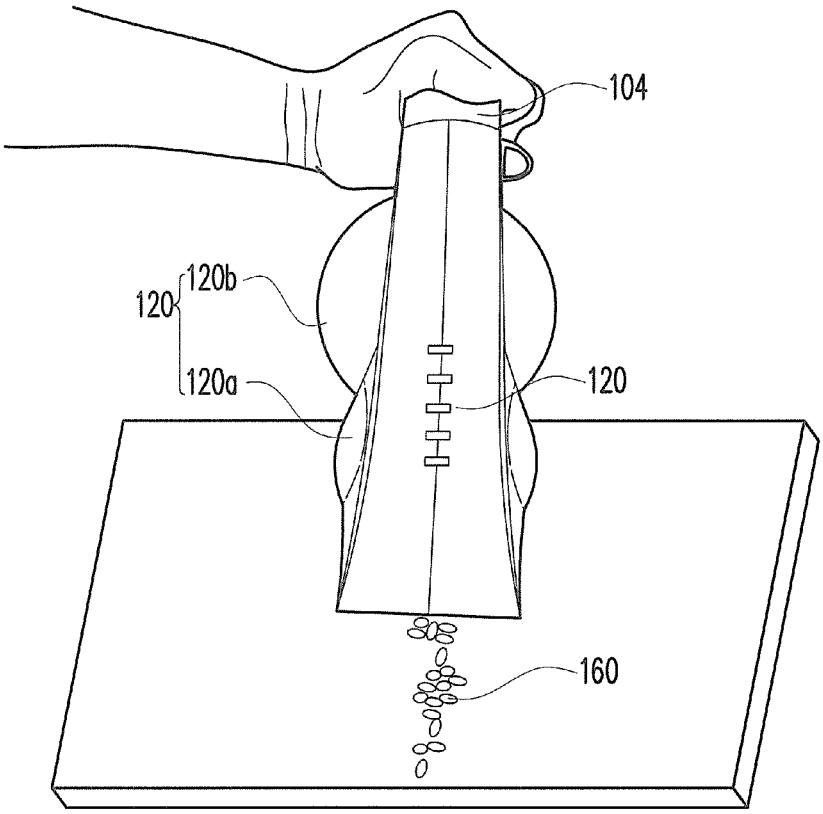

With reference to FIG. 11, when the suction cleaner collects dust particles or debris 160, the third sensing device 116 configured in the channel 110 between the impeller module 106 and the dust-suction opening 102*a* generates the sensing signal corresponding to the quantity of the collected dust particles or debris 160. When the suction cleaner collects a relatively small quantity of dust particles or debris 160, the controller 118 drives the impeller module 106 to continuously rotate at the second rotation rate (i.e., the medium rotation rate) after receiving the sensing signal. At this time, the controller 118 further drives the display device 120 to display the fourth signal corresponding to certain number of light, for example, 2~3 (the same number of light as the number of light corresponding to the third signal) or 3~4 (one more light than the number of light corresponding to the third signal). Alternatively, the controller 118 can drive the LCM or LCD panel to display other display signals in form of letters, patterns, or color. Thereby, it is shown that the suction cleaner is in the normal dust-suction state.

Figure 12:
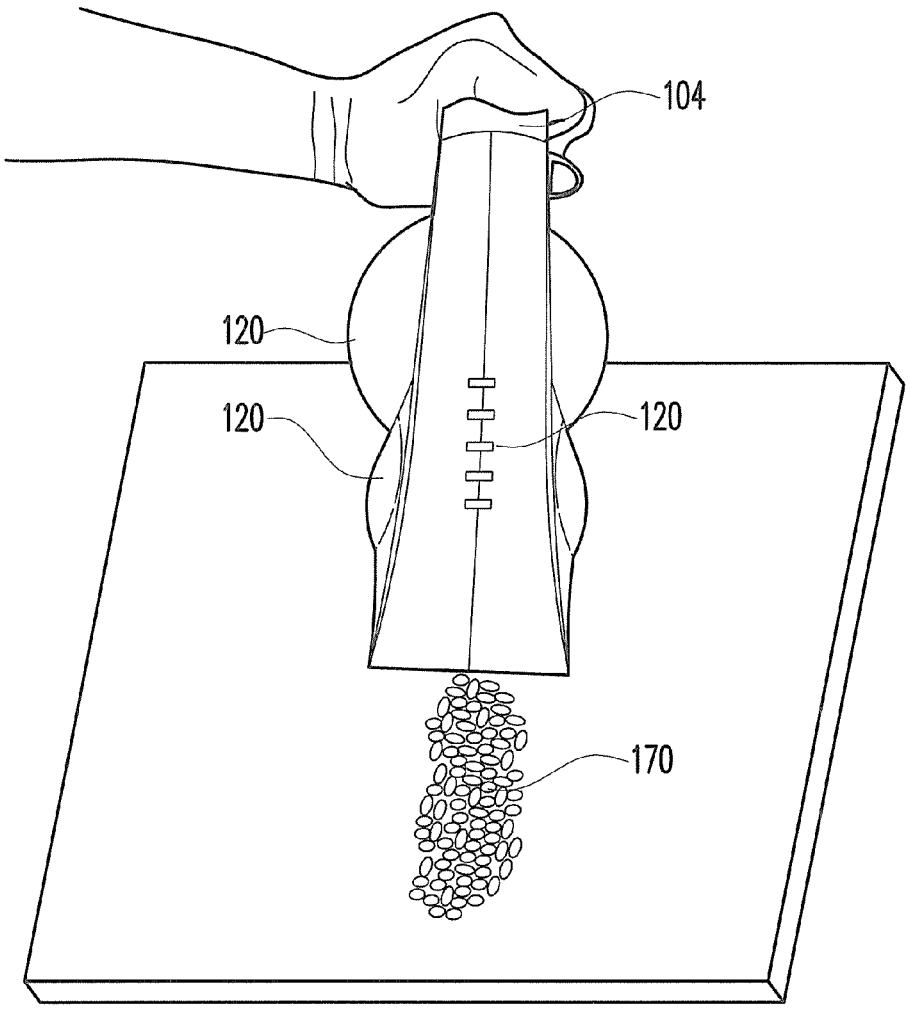

With reference to FIG. 12, when the suction cleaner collects a relatively large quantity of dust particles or debris 170, the third sensing device 116 configured in the channel 110 between the impeller module 106 and the dust-suction opening 102*a* generates the sensing signal corresponding to the quantity of the collected dust particles or debris 160. After the sensing signal is transmitted to the controller 118, the controller 118 drives the impeller module 106 to rotate at a third rotation rate (i.e., the maximum rotation rate), and the suction cleaner is in the maximum dust-suction state. At this time, the controller 118 also drives the display device 120 to display the fifth signal corresponding to certain number of light, for example, 3~4 or 4~5 (one more light than the number of light corresponding to the fourth signal). Alternatively, the controller 118 can drive the LCM or LCD panel to display other display signals in form of letters, patterns, or color. Thereby, it is shown that the suction cleaner is in the maximum dust-suction state.

Said operation is described on the condition that the impeller module in the suction cleaner can be rotated at three different rotation rates. However, the disclosure should not be construed as limited to the exemplary embodiments set forth herein. In other exemplary embodiments, the impeller module in the suction cleaner can have more than three rotation rates.

Figure 13:
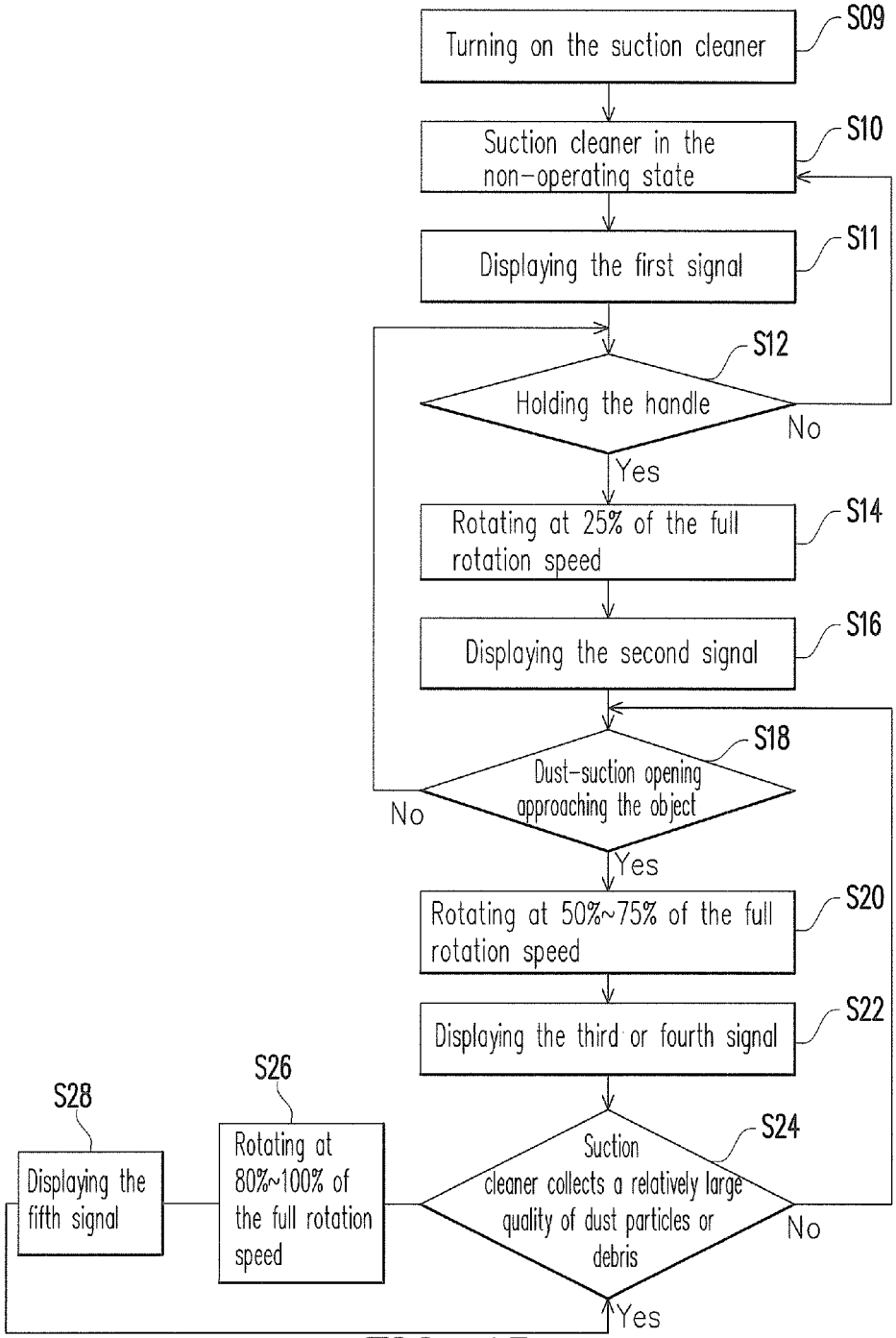
FIG. 13 is a schematic flow chart illustrating the operation of the suction cleaner according to an exemplary embodiment of the disclosure.

The operation method is shown in FIG. 13. To be more specific, after the suction cleaner is turned on (S09), the impeller module stays in the non-operating state (S10), and thus the suction cleaner here is in the standby state. At this time, the controller drives the display device to display the first signal (S11).

If the first sensing device fails to sense that the user is in contact with the holding part (S12), the operation method of the suction cleaner is then back to the step S10, such that the suction cleaner stays in the standby state. However, if the first sensing device senses that the user is in contact with the holding part (S12), the first sensing device transmits the sensing signal to the controller. After receiving the sensing signal, the controller drives the impeller module to rotate at the first rotation rate, e.g., 25% of the full rotation speed (S14), and the suction cleaner is in the ready-to-work state. At this time, the controller drives the display device to display the second signal (S16). The first rotation rate is exemplified as 25% of the full rotation speed in this exemplary embodiment, while the first rotation rate can be set otherwise in other exemplary embodiments of the disclosure.

If the second sensing device does not sense that the dust-suction opening comes close to or in contact with the tabletop or other objects (S18), the operation method of the suction cleaner is then back to the step S12, such that the suction cleaner continuously stays in the ready-to-work state. By contrast, if the second sensing device senses that the dust-suction opening comes close to or in contact with the tabletop or other objects (S18), the second sensing device transmits the sensing signal to the controller. After receiving the sensing signal, the controller drives the impeller module to rotate at the second rotation rate, e.g., 50%~75% of the full rotation speed (S20), and the suction cleaner is in the normal dust-suction state. At this time, the controller drives the display device to display the third signal (S22). The second rotation rate is exemplified as 50%~75% of the full rotation speed in this exemplary embodiment, while the second rotation rate can be set otherwise based on the actual requirements in other exemplary embodiments of the disclosure.

If the third sensing device does not sense suction of dust particles or debris (S24), the operation method of the suction cleaner is then back to the step S18, such that the suction cleaner continuously stays in the normal dust-suction state. By contrast, if the third sensing device senses suction of dust particles or debris (S24), the third sensing device transmits the sensing signal to the controller based on the amount of the sucked dust particles or debris. After receiving the sensing signal, the controller drives the impeller module to rotate at the third rotation rate or a higher rotation rate. For instance, when the third sensing device senses that the suction cleaner collects a relatively small quantity of dust particles or debris 160, the controller drives the impeller module to continuously rotate at the second rotation rate (i.e., the medium rotation rate), and the controller drives the display device to display the fourth signal. When the third sensing device senses that the suction cleaner collects a relatively large quantity of dust particles or debris 170, the controller drives the impeller module to rotate at the third rotation rate, e.g., 80%~100% of the full rotation speed (S26), and the suction cleaner is in the maximum dust-suction state. At this time, the controller drives the display device to display the fifth signal (S28). The third rotation rate is exemplified as 80%~100% of the full rotation speed in this exemplary embodiment, while the third rotation rate can be set otherwise based on the actual requirements in other exemplary embodiments of the disclosure.

It should be mentioned that the third sensing device in steps S24~S28 transmits different sensing signals to the controller based on the amount of the sucked dust particles or debris. The controller drives the impeller module to rotate at different rotation rates according to the sensing signals. Namely, the more the amount of the sucked dust particles or debris, the higher the rotation rate at which the controller drives the impeller module to rotate.

In light of the foregoing, the suction cleaner described in the exemplary embodiments of the disclosure has the first sensing device on the holding part, the second sensing device around the dust-suction opening, and the third sensing device in the channel between the impeller module and the dust-suction opening. Hence, after the suction cleaner is turned on, the rotation rate at which the impeller module rotates can be timely and spontaneously adjusted based on the operating condition of the suction cleaner (e.g., the standby state, collection of the dust particles/debris or not, and the quantity of the sucked dust particles/debris). In other words, after the suction cleaner described in the exemplary embodiments of the disclosure is turned on, the suction cleaner does not continuously operate at a high rotation rate and does not constantly consume significant power. As such, in comparison with the conventional handheld suction cleaner, the suction cleaner described in the exemplary embodiments of the disclosure contributes to reduction of power consumption.

Although the disclosure has been described with reference to the above exemplary embodiments, it will be apparent to one of the ordinary skill in the art that modifications to the described exemplary embodiments may be made without departing from the spirit of the disclosure. Accordingly, the scope of the disclosure will be defined by the attached claims rather than by the above detailed descriptions.

What is claimed is:

1. A suction cleaner comprising:

a housing, an end of the housing having a dust-suction opening;

a holding part connected to the housing;

an impeller module located inside the housing, a channel being configured between the dust-suction opening and the impeller module;

a first sensing device configured on the holding part;

a second sensing device configured around the dust-suction opening;

a third sensing device configured in the channel; and a controller electrically connected to the impeller module, the first sensing device, the second sensing device, and the third sensing device, wherein the controller drives the impeller module to rotate at a first rotation rate based on the sensing condition of the first sensing device, and the suction cleaner is in a ready-to-work state when the holding part of the suction cleaner is being contacted;

the controller drives the impeller module to rotate at a second rotation rate based on the sensing condition of the second sensing device, and the suction cleaner is in a normal dust-suction state when the suction cleaner comes close to or in contact with a surface of an object;

the controller drives the impeller module to continuously rotate at the second rotation rate based on the sensing condition of the third sensing device, and the suction cleaner maintains the normal dust-suction state when the suction cleaner collects a relatively small quantity of dust particles or debris; and the controller drives the impeller module to rotate at a third rotation rate based on the sensing condition of the third sensing device, and the suction cleaner is in a maximum dust-suction state when the suction cleaner collects a relatively large quantity of dust particles or debris.

2. The suction cleaner as recited in claim 1, wherein the impeller module comprises a motor and an impeller structure electrically connected to the motor.

3. The suction cleaner as recited in claim 1, wherein the first sensing device is configured inside or outside the holding part.

4. The suction cleaner as recited in claim 1, wherein the first sensing device is a contact sensing device or a non-contact sensing device, the contact sensing device is a button or a pressure sensor, and the non-contact sensing device is an infrared sensor, a light blocking sensor, or a photo sensor.

5. The suction cleaner as recited in claim 1, wherein the second sensing device is configured inside the dust-suction opening, outside the dust-suction opening, or on an edge of the dust-suction opening.

6. The suction cleaner as recited in claim 1, wherein the second sensing device is a contact sensing device or a non-contact sensing device, the contact sensing device is an elastic sensor or a pressure sensor, and the non-contact sensing device is an infrared sensor, a light blocking sensor, or a photo sensor.

7. The suction cleaner as recited in claim 1, wherein the third sensing device is a contact sensing device or a non-contact sensing device, the contact sensing device is a pressure sensor or a piezoelectric sensor, and the non-contact sensing device is an infrared sensor, a light blocking sensor, or a photo sensor.

8. The suction cleaner as recited in claim 1, further comprising a display device configured on the housing.

9. The suction cleaner as recited in claim 8, wherein the display device comprises a light emitting diode display panel, an organic light emitting display panel, or a liquid crystal display panel.

10. The suction cleaner as recited in claim 8, wherein the controller adjusts a display condition of the display device based on the sensing condition of the first, second, and third sensing devices.

11. The suction cleaner as recited in claim 1, further comprising:

a rechargeable battery and a charge jack, configured inside the housing and located at a side of the impeller module; and a power switch configured on the housing or the holding part.

12. The suction cleaner as recited in claim 1, further comprising a dust-collecting container located between the channel and the impeller module, the housing further comprising an air outlet configured corresponding to the impeller module.

13. An operation method of a suction cleaner, comprising:

providing the suction cleaner as recited in claim 1;

keeping the controller to be in a powered-on state and controlling the impeller module to be in a non-operating state after the suction cleaner is turned on, such that the suction cleaner is in a standby state;

driving the impeller module by the controller to rotate at a first rotation rate when the holding part of the suction cleaner is being contacted, such that the suction cleaner is in a ready-to-work state;

driving the impeller module by the controller to rotate at a second rotation rate when the suction cleaner comes close to or in contact with a surface of an object, such that the suction cleaner is in a normal dust-suction state;

driving the impeller module by the controller to continuously rotate at the second rotation rate when the suction cleaner collects a relatively small quantity of dust particles or debris; and driving the impeller module by the controller to rotate at a third rotation rate when the suction cleaner collects a relatively large quantity of dust particles or debris, such that the suction cleaner is in a maximum dust-suction state.

14. The operation method as recited in claim 13, wherein when the suction cleaner is in the standby state, the controller simultaneously drives a display device to display a first signal.

15. The operation method as recited in claim 13, wherein when the suction cleaner is in the ready-to-work state, the controller further drives a display device to display a second signal, so as to indicate that the suction cleaner is being held.

16. The operation method as recited in claim 13, wherein when the suction cleaner is in the normal dust-suction state, the controller further drives a display device to display a third signal, so as to indicate that the suction cleaner is close to or in contact with the object.

17. The operation method as recited in claim 13, wherein when the suction cleaner collects the relatively small quantity of dust particles or debris, the controller further drives a display device to display a fourth signal, so as to indicate that the suction cleaner is in the normal dust-suction state.

18. The operation method as recited in claim 13, wherein when the suction cleaner collects the relatively large quantity of dust particles or debris, the controller further drives a display device to display a fifth signal, so as to indicate that the suction cleaner is in the maximum dust-suction state.

19. The operation method as recited in claim 13, when the suction cleaner is in the standby state, the controller further driving a display device to display a first signal;

when the suction cleaner is in the ready-to-work state, the controller further driving the display device to display a second signal, so as to indicate that the suction cleaner is being held;

when the suction cleaner is in the normal dust-suction state, the controller further driving the display device to display a third signal, so as to indicate that the suction cleaner is close to or in contact with the object;

when the suction cleaner collects the relatively small quantity of dust particles or debris, the controller further driving the display device to display a fourth signal, so as to indicate that the suction cleaner is in the normal dust-suction state; and when the suction cleaner collects the relatively large quantity of dust particles or debris, the controller further driving the display device to display a fifth signal, so as to indicate that the suction cleaner is in the maximum dust-suction state, wherein the first, second, third, fourth, and fifth signals respectively correspond to certain number of light.

20. The operation method as recited in claim 19, wherein the number of light corresponding to the second signal is greater than the number of light corresponding to the first signal, the number of light corresponding to the third signal is greater than the number of light corresponding to the second signal, the number of light corresponding to the fourth signal is greater than the number of light corresponding to the third signal, and the number of light corresponding to the fifth signal is greater than the number of light corresponding to the fourth signal.

* * * * *